US009731345B2

(12) United States Patent
Jo et al.

(10) Patent No.: US 9,731,345 B2
(45) Date of Patent: Aug. 15, 2017

(54) MARTENSITIC STAINLESS STEEL HIGHLY RESISTANT TO CORROSION, AND METHOD FOR MANUFACTURING SAME

(75) Inventors: Ki-Hoon Jo, Pohang-si (KR); Dong-Chul Chae, Pohang-si (KR); Won-Qeun Son, Pohang-si (KR); Bong-Wn Kim, Pohang-si (KR)

(73) Assignee: POSCO, Pohang-si (KR)

( * ) Notice: Subject to any disclaimer, the term of this patent is extended or adjusted under 35 U.S.C. 154(b) by 540 days.

(21) Appl. No.: 13/823,502

(22) PCT Filed: Dec. 26, 2011

(86) PCT No.: PCT/KR2011/010123

§ 371 (c)(1),
(2), (4) Date: May 28, 2013

(87) PCT Pub. No.: WO2012/091394

PCT Pub. Date: Jul. 5, 2012

(65) Prior Publication Data

US 2013/0309126 A1 Nov. 21, 2013

(30) Foreign Application Priority Data

Dec. 27, 2010 (KR) ..... 10-2010-0135470

(51) Int. Cl.
*C22C 38/22* (2006.01)
*B22D 11/06* (2006.01)
(Continued)

(52) U.S. Cl.
CPC ..... *B22D 11/0622* (2013.01); *C21D 8/0215* (2013.01); *C21D 8/0263* (2013.01);
(Continued)

(58) Field of Classification Search
CPC ..... C22C 38/00; C22C 38/02; C22C 38/04; C22C 38/06; C22C 38/18; C22C 38/20;
(Continued)

(56) References Cited

U.S. PATENT DOCUMENTS 3,425,877 A * 2/1969 Deacon ..... B26B 21/58 148/578
5,433,801 A 7/1995 Althaus et al.
(Continued)

FOREIGN PATENT DOCUMENTS

CN 1351528 A 5/2002
DE 69700505 T2 5/2000
(Continued)

OTHER PUBLICATIONS

English machine translation of JP 2001271144 A of Sawada et al.*
(Continued)

*Primary Examiner* — Roy King
*Assistant Examiner* — Jophy S Koshy
(74) *Attorney, Agent, or Firm* — The Webb Law Firm

(57) ABSTRACT

Provided is a martensitic stainless steel having excellent productivity and high corrosion resistance, which comprises, as percentages by weight, 0.45 to 0.60% carbon, 0.02 to 0.08% nitrogen, 0.2 to 0.4% silicon, 0.3 to 0.6% manganese, 12 to 15% chromium, one or more kinds of 0.1 to 1.5% molybdenum or 0.1 to 1.5% tungsten and Fe and other unavoidable impurities as remnants.

3 Claims, 5 Drawing Sheets

(51) Int. Cl.

| | |
|---|---|
| ***C21D 8/02*** | (2006.01) |
| ***C21D 9/18*** | (2006.01) |
| ***C22C 38/00*** | (2006.01) |
| ***C22C 38/02*** | (2006.01) |
| ***C22C 38/04*** | (2006.01) |

(52) U.S. Cl.
CPC ..... *C21D 9/18* (2013.01); *C22C 38/00* (2013.01); *C22C 38/001* (2013.01); *C22C 38/02* (2013.01); *C22C 38/04* (2013.01); *C22C 38/22* (2013.01)

(58) Field of Classification Search
CPC ..... C22C 38/24; C22C 38/26; C22C 38/28; C22C 38/40
See application file for complete search history.

(56) References Cited

U.S. PATENT DOCUMENTS

| | | | |
|---|---|---|---|
| 5,807,444 | A | 9/1998 | Paradis et al. |
| 6,045,633 | A | 4/2000 | Henn et al. |
| 6,739,383 | B1 | 5/2004 | Marchionni et al. |
| 2004/0040631 | A1 | 3/2004 | Takahashi et al. |
| 2012/0321501 | A1 | 12/2012 | Chae et al. |
| 2013/0122320 | A1 | 5/2013 | Chae et al. |

FOREIGN PATENT DOCUMENTS

| | | | | | |
|---|---|---|---|---|---|
| DE | 60122164 | T2 | | 10/2007 | |
| GB | 1072621 | A | * | 6/1967 | ..... C21D 6/002 |
| JP | 5117805 | | | 5/1993 | |
| JP | 11061351 | A | | 3/1999 | |
| JP | 2001049399 | A | | 2/2001 | |
| JP | 2001271144 | A | * | 10/2001 | |
| JP | 2003313612 | | | 11/2003 | |
| JP | 2005125336 | | | 5/2005 | |
| JP | 2005206865 | A | | 8/2005 | |
| JP | 2007224405 | | | 9/2007 | |
| JP | 2007277639 | A | * | 10/2007 | ..... C22C 38/00 |
| JP | 2013514890 | | | 5/2013 | |
| JP | 2013514891 | | | 5/2013 | |
| KR | 1020000039375 | A | | 7/2000 | |

OTHER PUBLICATIONS

Qin Yang, "Research on structure of M2 High-Speed Steel cast strip carbide", Chongqing University Material Science & Engineering Graduate School, Apr. 2009.

* cited by examiner

Inventive steel 1

Comparative steel 1

MARTENSITIC STAINLESS STEEL HIGHLY RESISTANT TO CORROSION, AND METHOD FOR MANUFACTURING SAME

CROSS REFERENCE TO RELATED APPLICATIONS

This application is the United States national phase of International Application No. PCT/KR2011/010123 filed Dec. 26, 2011, and claims priority to Korean Patent Application No. 10-2010-0135470 filed Dec. 27, 2010, the disclosures of which are hereby incorporated in their entirety by reference.

TECHNICAL FIELD

An aspect of the present invention relates to a high corrosion resistance martensitic stainless steel and production method therefor, and more particularly, to a high corrosion resistance martensitic stainless steel used to produce a razor blade and production method therefore.

BACKGROUND ART

In general, a high hardness stainless steel is used in producing a razor blade so as to secure corrosion resistance and machinability at the same time. The stainless steel is a stainless steel that mainly contains 12% or more chromium and 0.6% or more carbon. The stainless steel secures high hardness by employing carbon after final heat-treatment, and secures corrosion resistance in a wet environment due to the influence of chromium contained in a base material. Conventionally, there was known a method for producing steel for razor blade, by adding, to the steel, carbon having a content of 0.65 to 0.7% and chromium having a content of 12.7 to 13.7%. However, when the steel is produced with the composition described above, carbide formed inside the material is not completely employed in a heat treatment process, and therefore, a chromium-deficient layer is formed, thereby lowering the corrosion resistance of the material. As the material is exposed to a wet environment such as a bathroom for a long period of time, the surface of a razor blade is corroded, and therefore, rust occurs in the surface of the razor blade.

In order to solve such a problem, the content of carbon is limited to 0.45 to 0.55%, and molybdenum is added to the material, so that it is possible to prevent the occurrence of carbide remaining in the finally heat-treated material and to improve the corrosion resistance of the base material. However, such steel contains high silicon in order to prevent the lowering of hardness due to the reduction in carbon. In the steel containing high silicon, the hardness of a hot-rolled annealed material increases, and therefore, it is not easy to produce the steel using a production process of general stainless steel.

DISCLOSURE OF INVENTION

Technical Problem

Accordingly, an object of the present invention is to provide a martensitic stainless steel for high-quality razor blade having excellent corrosion resistance.

Another object of the present invention is to provide a production method for a martensitic stainless steel for high-quality razor blade having high corrosion resistance and excellent productivity.

Technical Solution

According to an aspect of the present invention, there is provided a high corrosion resistance martensitic stainless steel comprising, as percentages by weight, 0.45 to 0.60% carbon, 0.02 to 0.08% nitrogen, 0.2 to 0.4% silicon, 0.3 to 0.6% manganese, 12 to 15% chromium, 0.1 to 1.5% molybdenum and Fe and other unavoidable impurities as remnants.

According to another aspect of the present invention, there is provided a high corrosion resistance martensitic stainless steel comprising, as percentages by weight, 0.45 to 0.60% carbon, 0.02 to 0.08% nitrogen, 0.2 to 0.4% silicon, 0.3 to 0.6% manganese, 12 to 15% chromium, 0.1 to 1.5% tungsten and Fe and other unavoidable impurities as remnants.

According to another aspect of the present invention, there is provided a high corrosion resistance martensitic stainless steel comprising, as percentages by weight, 0.45 to 0.60% carbon, 0.02 to 0.08% nitrogen, 0.2 to 0.4% silicon, 0.3 to 0.6% manganese, 12 to 15% chromium, 0.1 to 1.5% molybdenum and 0.1 to 1.5% tungsten and Fe and other unavoidable impurities as remnants.

The final heat-treatment hardness of the stainless steel may be within a range of 500 to 750HV.

The pitting resistance equivalent number (PREN) of the stainless steel has a value of 15 or more by the following Formula 1.

$$PREN=\%\ Cr+3.3(\%\ Mo+0.5\%\ W)+16\%\ N \qquad \text{Formula 1:}$$

The Charpy impact energy of a material hot-rolled through batch annealing may be 6J or more (a thickness of 4 mm or more).

According to still another aspect of the present invention, there is provided a production method for a high corrosion resistance martensitic stainless steel, wherein, in a strip-casting device comprising a pair of rolls rotating in opposite directions, edge dams respectively provided to both sides of the rolls so as to form a molten steel pool, and a meniscus shield for supplying inert nitrogen gas to the upper surface of the molten steel pool, a stainless-steel thin sheet is cast by supplying a stainless molten steel containing, as percentages by weight, 0.45 to 0.60% carbon, 0.02 to 0.08% nitrogen, 0.2 to 0.4% silicon, 0.3 to 0.6 manganese and 12 to 15% chromium, one or more kind of 0.1 to 1.5% molybdenum or 0.1 to 1.5% tungsten and Fe and other unavoidable impurities as remnants, to a molten steel pool from a tundish via a nozzle, and the cast stainless-steel thin sheet is made into a hot-rolled annealed strip using in-line roller.

Advantageous Effects

According to the present invention, it is possible to obtain a martensitic stainless steel available for high-quality razor blade having excellent corrosion resistance in a wet environment.

Further, it is possible to easily produce a martensitic stainless steel for razor blade having high hardness.

BEST MODE FOR CARRYING OUT THE INVENTION

Figure 1:
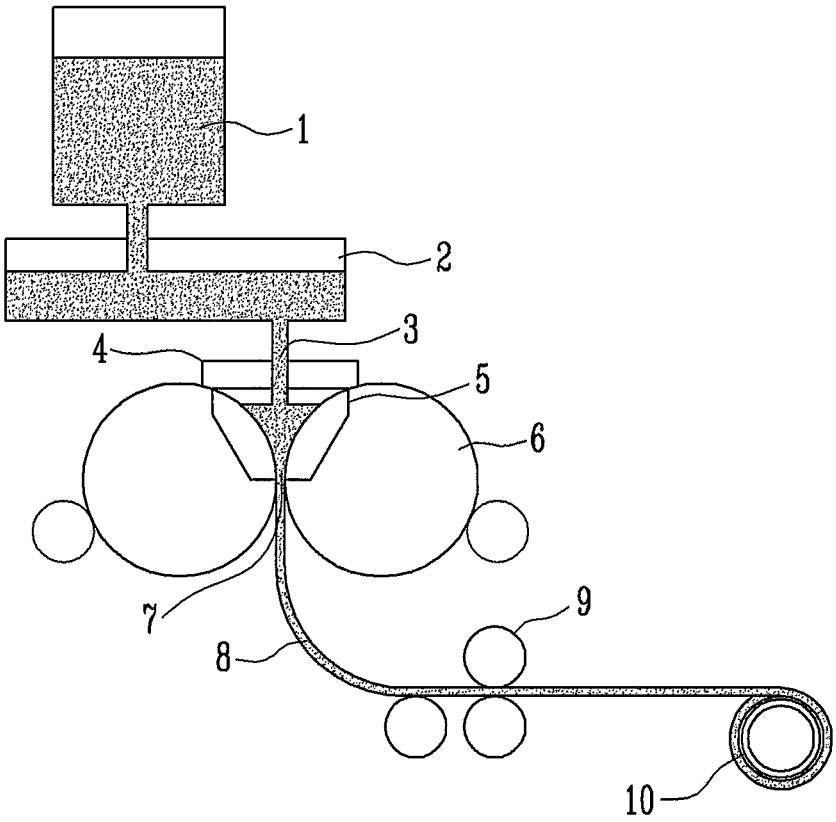
FIG. 1 is a schematic view of a strip casting process to which the present invention is applied.

Hereinafter, preferred embodiments of the present invention will be described in detail with reference to the accompanying drawings. However, the present invention is not limited to the embodiments but may be implemented into different forms. These embodiments are provided only for illustrative purposes and for full understanding of the scope of the present invention by those skilled in the art. Throughout the drawings, like elements are designated by like reference numerals.

A high corrosion resistance martensitic stainless steel for razor blade according to the present invention comprises, as percentages by weight, 0.45 to 0.60% carbon, 0.02 to 0.08% nitrogen, 0.2 to 0.4% silicon, 0.3 to 0.6% manganese, 12 to 15% chromium, and Fe and other unavoidable impurities as remnants. The stainless steel may further comprise any one or more of 0.1 to 1.5% molybdenum and 0.1 to 1.5% tungsten.

In the present invention, the composition of the alloy is designed with three viewpoints. The first viewpoint is to improve workability, the second viewpoint is to improve corrosion resistance, and the third viewpoint is to secure preferable hardness.

In order to improve workability, it is important to secure ductility of an annealed material. To this end, the content of silicon is designed to optimally secure ductility without lowering hardness.

Particularly, the inventor has verified through various experiments of the present invention that the limitation of the content of silicon in the martensitic steel containing high carbon secures the ductility of a hot-rolled annealed material, which is considerably advantageous in its production method.

Generally, it is known that silicon is added to improve the hardness of the hot-rolled annealed material. However, it has been verified that the silicon remarkably contributes to the improvement of the hardness of the hot-rolled annealed material but does not much contribute to the improvement of the hardness of a finally heat-treated material. Particularly, molybdenum, tungsten and the like are added to a high corrosion resistance steel in order to secure damping resistivity in a heat treatment process, together with the solid solution hardening effect. Therefore, it is considered that the security of hardness using the silicon is negligible.

Further, the molybdenum and tungsten can be multiply added to the high corrosion resistance steel in order to improve the corrosion resistance. This is because it has been verified that the molybdenum added to improve the corrosion resistance of existing martensitic steel can be replaced by adding the tungsten.

Further, in order to secure the optimum hardness for the use of razor blade, the content of carbon is optimized, thereby maximally obtaining the solid solution hardening effect while preventing the generation of carbide. The high-carbon martensitic stainless steel can obtain a finally heat-treated hardness of 500 to 750HV.

In the present invention, a strip casting process is applied rather than a typical continuous casting process, based on the design of the alloy.

Hereinafter, the function of the content of each composition and the reason for limiting its additional range will be described. In addition, percentages (%) described hereinbelow are all percentages by weight (wt %).

When the content of the carbon is low, the hardness of martensite is lowered, and hence it is impossible to secure machinability. Therefore, more than 0.45% carbon is added. However, if the content of the carbon is excessive, the corrosion resistance of the material is lowered through the formation of carbide, and therefore, the maximum content of the carbon is limited to 0.6%. However, more than 0.5% carbon is preferably added.

The nitrogen contributes to the strength and corrosion resistance of the martensitic stainless steel, and hence more than 0.02% nitrogen is added. However, if the nitrogen is excessively added, pores may be generated by the nitrogen in molding. Therefore, the maximum content of the nitrogen is limited to 0.08%.

The silicon is one of elements important in the design of the alloy of the present invention. The silicon is an element essentially added for the purpose of its deoxidation, and hence more than 0.2% silicon is added. However, if the silicon is excessively added, the hardness of a material annealed after being hot-rolled is increased, thereby lowering productivity. Therefore, the maximum content of the silicon is limited to 0.4%.

Generally, the content of silicon is increased to improve the hardness of the hot-rolled annealed material. However, in the present invention, it has been verified that the content of the silicon remarkably contributes to the improvement of the hardness of an annealed material but does not much contribute to the improvement of the hardness of a finally heat-treated material. In the annealed material, solid solution carbon is mostly extracted in the form of carbide, and thus the hardness of the annealed material is increased by the silicon that is a representative hardening element. However, in the finally heat-treated material, carbon is mostly solid-solved in a base material, and therefore, an increase in hardness is caused. Accordingly, the effect of the silicon is relatively insignificant.

Figure 3:
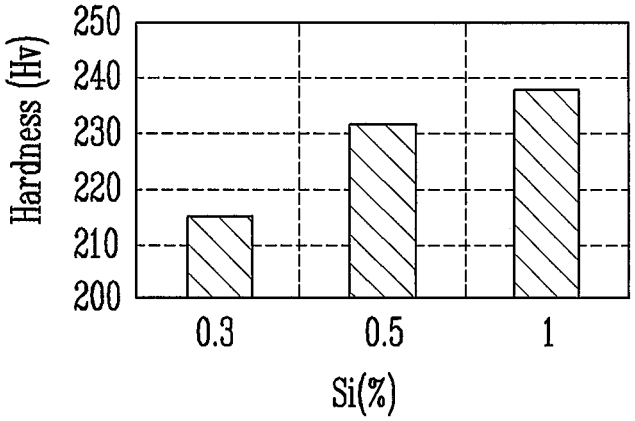
FIG. 3 is a graph showing hardnesses with respect to contents of silicon contained in a hot-rolled annealed material according to the present invention.
Figure 4:
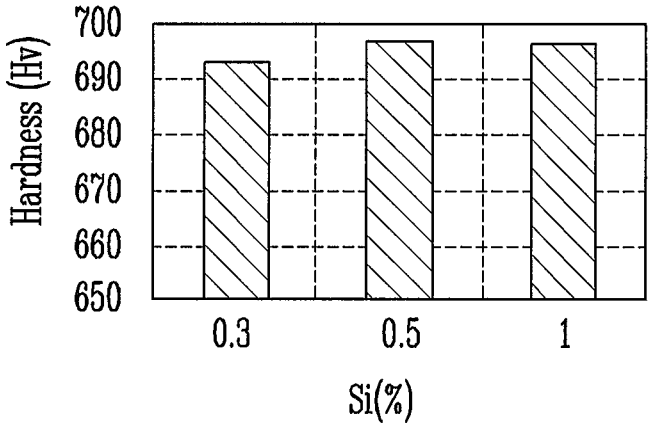
FIG. 4 is a graph showing hardnesses of a finally heat-treated material according to the present invention.

The relationship between hardness and contents of silicon will be described with reference to FIGS. 3 and 4. FIG. 3 is a graph showing hardnesses with respect to contents of silicon contained in a hot-rolled annealed material according to the present invention. FIG. 4 is a graph showing hardnesses of a finally heat-treated material according to the present invention.

In FIG. 3, the hardness of the hot-rolled annealed material is increased to 230HV or more when the content of silicon from 0.3% to 0.5% and 1%. In a case where the hardness of the hot-rolled annealed material is increased as described above, the degradation of the annealed material of the stainless steel according to the present invention occurs, and therefore, a problem of cracks or the like may occur when the martensitic stainless steel is produced using a general strip casting production apparatus.

Meanwhile, in FIG. 4, the change in the hardness of the finally heat-treated material is not great when the content of silicon is 0.3%, 0.5% or 1%. As described above, in the annealed material, solid solution carbon is mostly extracted in the form of carbide, and thus the hardness of the annealed material is increased by the silicon that is a representative hardening element. However, in the finally heat-treated material, carbon is mostly solid-solved in a base material, and therefore, an increase in hardness is caused. Accordingly, the effect of the silicon is relatively insignificant. Hence, in the present invention, the content of silicon is limited from 0.2% to 0.4%.

The manganese is an element essentially added for the purpose of its deoxidation, and hence more than 0.3% manganese is added. However, if the manganese is excessively added, the surface quality of steel is degraded, and the increase in hardness is restricted through the formation of remaining austenite. Therefore, the maximum content of the manganese is limited to 0.6%.

The chromium is a basic element for securing corrosion resistance, and hence more than 12% chromium is added. However, if the chromium is excessively added, production cost is increased, and the solid solution carbon of the finally heat-treated material may be lowered through the formation of carbide. Therefore, the maximum content of the chromium is limited to 15%.

In the present invention, more than 0.1% molybdenum is added in order to improve corrosion resistance. However, if the molybdenum is excessively added, production cost is increased. Therefore, the maximum content of the molybdenum is limited to 1.5%.

In the present invention, more than 0.1% tungsten is added in order to improve corrosion resistance. However, if the tungsten is excessively added, production cost is increased. Therefore, the maximum content of the tungsten is limited to 1.5%.

In the present invention, the molybdenum or tungsten may contain one or two kinds thereof. Preferably, the molybdenum and the tungsten are multiply added, thereby improving corrosion resistance.

In the present invention, a high pitting resistance equivalent number (PREN) of the martensitic stainless steel can be obtained by multiply adding the molybdenum and the tungsten and increasing the content of the chromium a little more. The PREN may be obtained by the following Formula 1. The preferable PREN of the present invention is 15 or more.

$$\text{PREN}=\%\ \text{Cr}+3.3(\%\ \text{Mo}+0.5\%\ \text{W})+16\%\ \text{N} \qquad \text{Formula 1:}$$

In the present invention, the martensitic stainless steel is produced through the scrip casting process shown in FIG. 1. The martensitic stainless passes through a heat treatment process using a unique method in order to obtain an appropriate physical property suitable for the use thereof.

Hereinafter, a production process of the present invention will be described.

FIG. 1 is a schematic view of a strip casting process to which the present invention is applied. As can be seen in FIG. 1, the strip casting process of the present invention is a process of producing a hot-rolled strip of a thin material directly from a molten steel having the composition described above. The strip-casting process is a new steel production process capable of remarkably reducing production cost, facility investment cost, amount of energy used, amount of exhaust gas, and the like by omitting a hot rolling process. In a twin roll strip caster used in a general strip-casting process, as shown in FIG. 1, a molten steel is accommodated in a ladle 1 and then flowed in a tundish 2 along a nozzle. The molten steel flowed in the tundish 2 is supplied between edge dams 5 respectively provided to both end portions of casting rolls 6, i.e., between the casting rolls 6, through a molten steel injection nozzle 3 so that the solidification of the molten steel is started. In this case, a molten metal surface is protected with a meniscus shield 4 in a molten metal portion so as to prevent oxidation, and an appropriate gas is injected into the molten metal portion so as to form an appropriate atmosphere. A thin sheet 8 is produced while being extracted from a roll nip 7 formed between both the rolls, and rolled between rollers 9. Then, the rolled thin sheet goes through a cooling process, and is wound around a winding roll 10. In this case, the important technique in a twin roll strip casting process of directly producing a thin sheet with a thickness of 10 mm or less from a molten steel is to produce a thin sheet with a desired thickness, which has no crack and an improved real yield by supplying the molten steel through an injection nozzle between internal air-cooled twin rolls rotating in opposite direction at a high speed.

Hereinafter, the heat treatment process of the present invention will be described in detail through an embodiment.

Embodiment

In this embodiment, five inventive steels and two comparative steels were produced by chemical formulae of Table 1. The produced samples were hot-rolled through reheating at 1200° C. for two hours, thereby producing hot-rolled plates with a thickness of 4 mm.

TABLE 1

| Kind of steel | C | Si | Mn | Cr | Mo | W | N |
|---|---|---|---|---|---|---|---|
| Inventive steel 1 | 0.50 | 0.2 | 0.3 | 12.8 | 0.2 | 0.8 | 0.062 |
| Inventive steel 2 | 0.59 | 0.3 | 0.4 | 14.3 | 0.5 | 1.3 | 0.038 |
| Inventive steel 3 | 0.56 | 0.4 | 0.3 | 14.2 | 1.2 | 0.4 | 0.040 |
| Inventive steel 4 | 0.55 | 0.4 | 0.4 | 14.6 | 0.3 | 0.6 | 0.044 |
| Inventive steel 5 | 0.51 | 0.3 | 0.5 | 13.7 | 0.4 | 0.6 | 0.033 |
| Inventive steel 6 | 0.47 | 0.3 | 0.4 | 13.2 | 0.4 | 0.7 | 0.045 |
| Comparative steel 1 | 0.71 | 0.3 | 0.7 | 13.2 | — | — | 0.032 |
| Comparative steel 2 | 0.50 | 0.8 | 0.7 | 12.5 | 1.3 | — | 0.031 |

The hot-rolled annealed material was produced by performing a BAF process of annealing a hot-rolled plate at 850° C. for 20 hours, and scale formed in a hot-rolling process was removed through a shot blasting process. The hot-rolled annealed material was pickled in a mixture solution of nitric acid and sulfuric acid and then cold-rolled at a reduction ratio of 50%, thereby producing a finally cold-rolled material.

Generally, the martensitic stainless steel containing high carbon is produced using an ingot casting method. In the ingot casting method, the coagulation time of an ingot is maintained for a long period of time, and therefore, carbide may be segregated at the center portion of the ingot in the coagulation of the ingot. If segregation is formed once, it is difficult to remove the segregation in a subsequent process, which obstructs corrosion resistance or blade-end quality.

In the present invention, to solve such a problem, the segregation of carbide occurring in the coagulation of the ingot is improved using the strip casting process of producing a thin plate through rapid cooling in a molten steel pool, thereby producing a martensitic steel with excellent quality.

Figure 2:
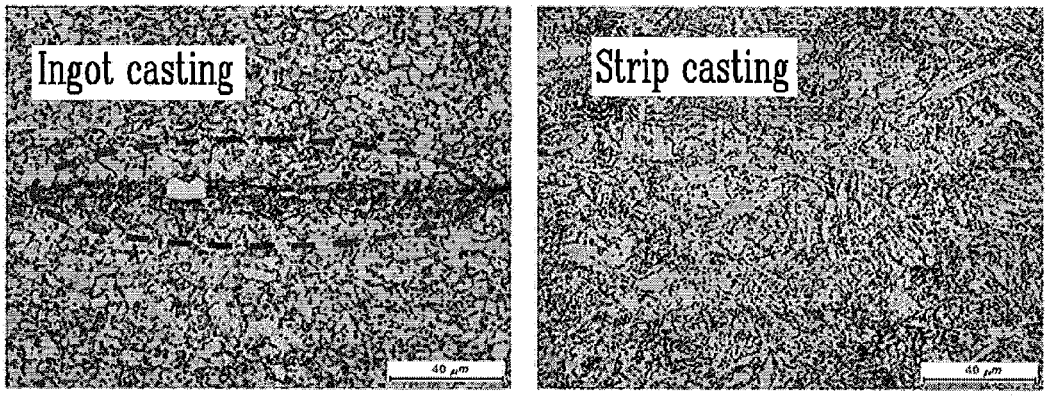
FIG. 2 is a scanning electron microscope (SEM) photograph comparing microstructures of a martensitic steel of the present invention, produced using ingot casting, and a martensitic steel of the present invention, produced using strip casting.

FIG. 2 is a scanning electron microscope (SEM) photograph comparing microstructures of a martensitic steel of the present invention, produced using ingot casting, and a martensitic steel of the present invention, produced using strip casting. As shown in FIG. 2, it can be seen that the segregation of carbide at the center portion of the ingot is serious in the ingot casting, and the segregation of carbide hardly exist in the strip casting. Accordingly, in a case where the inventive steel is produced using the strip casting, the martensitic steel having a uniform micro-structure can be produced as compared with that produced using the ingot casting.

Meanwhile, in the stainless steel having the composition of the present invention, the limitation of the content of silicon in the martensitic steel containing high carbon secures the ductility of a hot-rolled annealed material, which is considerably advantageous in its production method.

Generally, it is known that silicon is added to improve the hardness of the hot-rolled annealed material. However, it has been verified that the silicon remarkably contributes to the improvement of the hardness of the hot-rolled annealed material but does not much contribute to the improvement of the hardness of a finally heat-treated material. Particularly, molybdenum, tungsten and the like are added to a high corrosion resistance steel in order to secure damping resistivity in a heat treatment process, together with the solid solution hardening effect. Therefore, it is considered that the security of hardness using the silicon is negligible. This is the same as described with reference to FIGS. 3 and 4.

In addition, it has been verified that the molybdenum added to improve the corrosion resistance of existing martensitic steel can be replaced by adding the tungsten. The high-carbon martensitic stainless steel can obtain a finally heat-treated hardness of 500 to 750HV.

Next, in the present invention, samples were prepared by cold-rolling a hot-rolled plate to a thickness of 2 mm and then performing hardening heat treatment on the cold-rolled plate at 1100° C. for 20 seconds in order to estimate corrosion resistance. Generally, razor blade is used under the environment of tap water at normal temperature. However, an experiment was performed by immersing the razor blade in 0.05% NaCl at 85° C. for the purpose of an accelerated experiment.

Table 2 shows the presence of occurrence of rust on the surface of the razor blade after the razor blade is immersed in the 0.05% NaCl for two hours.

TABLE 2

| Kind of steel | Presence of occurrence of rust |
|---|---|
| Inventive steel 1 | X |
| Inventive steel 2 | X |
| Inventive steel 3 | X |
| Inventive steel 4 | X |
| Inventive steel 5 | X |
| Inventive steel 6 | X |
| Comparative steel 1 | ○ |
| Comparative steel 2 | X |

Figure 5:
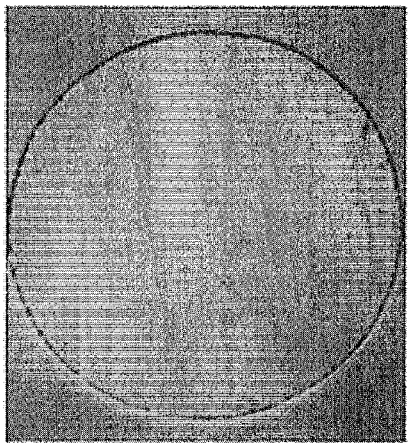
FIG. 5 is an SEM photograph showing the presence of occurrence of rust after a corrosion test is performed on an inventive steel and a comparative steel.
Figure 5:
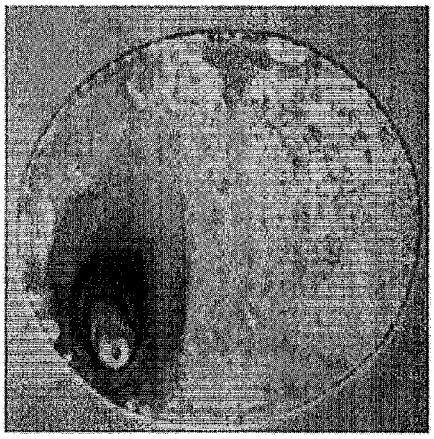
Figure 6:
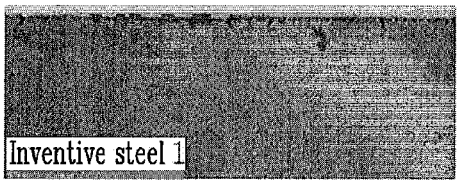
FIG. 6 is an SEM photograph showing edge portions of plates rolled at a reduction ratio of 80% with respect to the inventive steel and a non-u steel.
Figure 6:
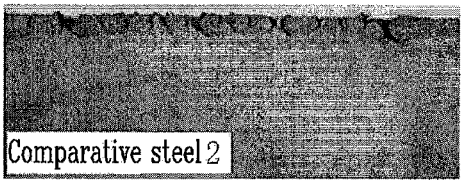

FIG. 5 is an SEM photograph showing the presence of occurrence of rust after a corrosion test is performed on Inventive steel 1 and Comparative steel 1. FIG. 6 is an SEM photograph showing edge portions of plates rolled at a reduction ratio of 80% with respect to Inventive steel 1 and Comparative steel 2.

As can be seen in FIG. 5, the degree of occurrence of rust in Comparative steel 1 is very serious as compared with Inventive steel 1. In a case where a corrosion test is performed as described above, much rust occurs in the comparative steel beyond the composition range of the present invention, and therefore, the corrosion resistance is inferior. However, in the inventive steel, rust hardly occurs, and thus the corrosion resistance is superior to that of Comparative steel 1.

In FIG. 6, the corrosion resistance of Comparative steel 2 after being rolled by 80% is inferior to that of Inventive steel, and more cracks occurs around the edge portion of Comparative steel 2 as compared with Inventive steel 1. This is because the quality at the edge portion of Inventive steel 1 is superior to that in Comparative steel 2.

Meanwhile, the inventive steel having molybdenum and tungsten added thereto can obtain corrosion resistance higher than steel having no molybdenum and tungsten added thereto under a chlorine atmosphere.

Figure 7:
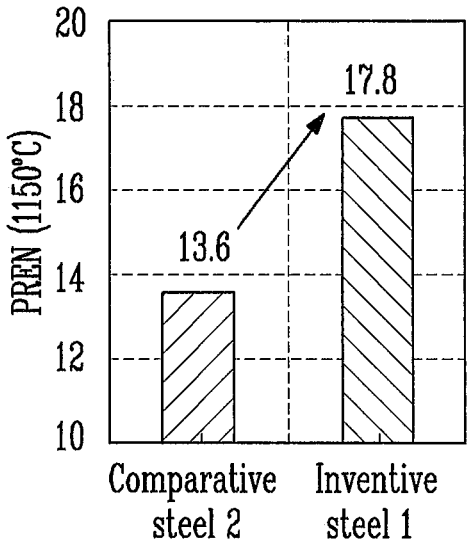
FIG. 7 is a graph showing that the pitting resistance equivalent number (PREN) of the inventive steel is improved due to complex addition of molybdenum and tungsten according to the present invention.

FIG. 7 is a graph showing that the PREN of the inventive steel is improved due to complex addition of molybdenum and tungsten according to the present invention. In the present invention, a high PREN of the martensitic stainless steel can be obtained by multiply adding the molybdenum and the tungsten and increasing the content of the chromium a little more. In this embodiment, a high PREN of 17.8 can be obtained as compared with that of 13.6 in the comparative steel.

The PREN may be obtained by the following Formula 1. The preferable PREN of the present invention is 15 or more.

$$\text{PREN}=\%\ \text{Cr}+3.3(\%\ \text{Mo}+0.5\%\ \text{W})+16\%\ \text{N} \qquad \text{Formula 1:}$$

Meanwhile, in the martensitic material having a high content of carbon, the hardness of a base material is high, and a large amount of carbide is segregated. Therefore, it is highly likely that a defect such as a crack at the edge portion of the material or fracture of the material may occur in the cold-rolling and pickling process. Accordingly, unlike typical stainless steel, the productivity is a very important factor in mass-production process.

In order to verify facilitation in production of the inventive steel, samples were produced by preparing a hot-rolled plate with a thickness of 4 mm and then performing an annealing process applied to the production process of the typical martensitic steel. When comparing hardnesses, elongation percentages and impact values of the produced samples, the facilitation in production can be indirectly verified in the cold-rolling or pickling process. That is, if the ductility of the hot-rolled annealed material is secured, the productivity is facilitated in subsequent processes such as cold-rolling and pickling processes. If the ductility of the hot-rolled annealed material is not secured, the productivity is deteriorated.

Table 3 shows physical properties obtained through the experiments describe above. In Table 3, it can be seen that the inventive steel produced by decreasing the content of carbon and simultaneously controlling the content of silicon has Charpy impact energy superior to the comparative steel having a high content of carbon or silicon. In this case, the impact energy may be changed depending on the thickness and reduction ratio of a material. However, in this embodiment, an impact energy of 6J or more can be obtained by producing a hot-rolled plate with a thickness of 4 mm or more.

TABLE 3

| Kind of steel | Charpy impact energy (J) (based on 4 mm) | Hardness (Hv) in batch annealing |
|---|---|---|
| Inventive steel 1 | 6.6 | 208 |
| Inventive steel 2 | 6.5 | 205 |
| Inventive steel 3 | 6.3 | 206 |
| Inventive steel 4 | 6.5 | 205 |
| Inventive steel 5 | 7.1 | 202 |
| Inventive steel 6 | 7.3 | 203 |
| Comparative steel 1 | 2.8 | 213 |
| Comparative steel 2 | 4.4 | 230 |

Figure 8:
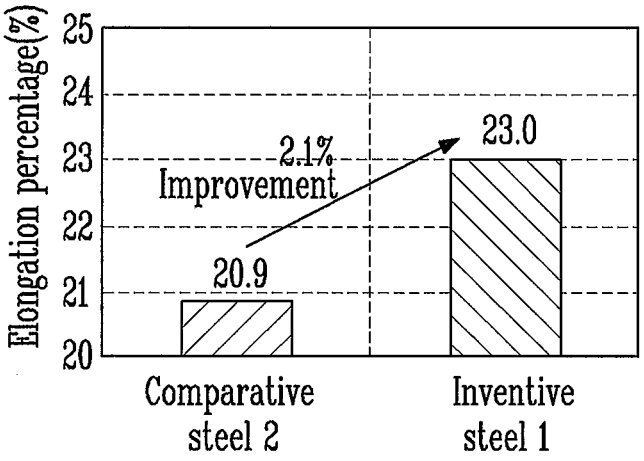
FIG. 8 is a graph showing that the elongation percentage of the hot-rolled annealed material is improved when the content of silicon is limited in a martensitic steel containing high carbon.

FIG. 8 is a graph showing that the elongation percentage of the hot-rolled annealed material is improved when the content of silicon is limited in a martensitic steel containing high carbon. As can be seen in FIG. 8, the content of silicon in Comparative steel 2 is excessive as compared with that in Inventive steel 1. Thus, the elongation percentage of the inventive steel is remarkably improved as compared with that of Comparative steel 2. Accordingly, it can be seen in Table 3 and FIG. 8 that no edge crack or the like occurs in the inventive steel due to the improvement of elongation percentage and impact toughness, thereby remarkably improving productivity.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

The invention claimed is:

1. A martensitic cold-rolled and finally heat-treated stainless steel sheet comprising, as percentages by weight, 0.45 to 0.60% carbon, 0.02 to 0.08% nitrogen, 0.2 to 0.4% silicon, 0.3 to 0.6% manganese, 12 to 15% chromium, 0.1 to 1.5% molybdenum, and 0.6 to 1.5% tungsten, balance Fe and other unavoidable impurities, wherein the final heat-treatment hardness of the stainless steel sheet is within a range of 500 to 750HV, and wherein no rust is formed on the surface of the finally heat-treated stainless steel sheet after immersion in a 0.05% NaCl solution at 85° C. for two hours.

2. The stainless steel sheet of claim 1, wherein the pitting resistance equivalent number (PREN) of the stainless steel has 15 or more by the following Formula 1;

$$PREN=\%\ Cr+3.3(\%\ Mo+0.5\%\ W)+16\%\ N. \qquad \text{Formula 1:}$$

3. The stainless steel sheet of claim 1, wherein the stainless steel comprising, as percentages by weight, 0.5 to 0.60% carbon.

* * * * *